US008226070B2

(12) United States Patent
Froud

(10) Patent No.: US 8,226,070 B2
(45) Date of Patent: Jul. 24, 2012

(54) PRACTICE FENCE FOR TENNIS AND SIMILAR GAMES

(76) Inventor: Robert Thomas James Froud, Bexley (GB)

( * ) Notice: Subject to any disclaimer, the term of this patent is extended or adjusted under 35 U.S.C. 154(b) by 178 days.

(21) Appl. No.: 12/376,638

(22) PCT Filed: Aug. 9, 2007

(86) PCT No.: PCT/GB2007/003028

§ 371 (c)(1),
(2), (4) Date: Apr. 13, 2009

(87) PCT Pub. No.: WO2008/017847

PCT Pub. Date: Feb. 14, 2008

(65) Prior Publication Data

US 2010/0108968 A1 May 6, 2010

(30) Foreign Application Priority Data

Aug. 9, 2006 (GB) ..... 0615811.7
Feb. 9, 2007 (GB) ..... 0702569.5

(51) Int. Cl.
*E04H 17/16* (2006.01)

(52) U.S. Cl. ..... 256/24; 473/435

(58) Field of Classification Search ..... 256/32, 256/45, 24, 12.5, 33, 1, 5, 19, 73; 181/284, 181/290; 52/144, 145; 405/302.6, 302.7; 273/396, 407, 410; 473/434, 435, 459, 469, 473/473, 474, 476, 490, 494
See application file for complete search history.

(56) References Cited

U.S. PATENT DOCUMENTS 2,177,393 A * 10/1939 Parkinson ..... 52/145
2,205,398 A * 6/1940 Eaton ..... 472/94
3,273,862 A * 9/1966 Miller ..... 256/73
3,779,547 A * 12/1973 Pappas ..... 472/92
3,883,120 A 5/1975 Tipmann
3,951,406 A * 4/1976 Rock ..... 472/94
4,093,218 A * 6/1978 Burchers ..... 473/435
4,325,457 A * 4/1982 Docherty et al. ..... 181/210
4,373,720 A * 2/1983 Lombardi et al. ..... 473/434
(Continued)

FOREIGN PATENT DOCUMENTS

BE 1 012 179 A3 6/2000
(Continued)

OTHER PUBLICATIONS

International Search Report of PCT/GB2007/003028 mailed Mar. 4, 2008, 2 pages.

*Primary Examiner* — Michael P Ferguson
*Assistant Examiner* — Daniel Wiley
(74) *Attorney, Agent, or Firm* — Summa, Additon & Ashe, P.A.

(57) ABSTRACT

A fence for tennis practice is disclosed that includes a plurality of rigid mesh panels (18) supported by upright posts (10), preferably with noise reduction strips (30, 32, 33) between them. The mesh panels are secured together side by side to form a substantially flat continuous surface and edges (26, 28) of adjacent panels are bent backwards to abut one another and a side surface of one of the upright posts. The edges are then secured together and to the posts by bolts (23) or the like. There is thus provided a surface having substantially uniformed rebound properties at whatever position it is struck by a tennis ball.

17 Claims, 5 Drawing Sheets

U.S. PATENT DOCUMENTS

| | | | | |
|---|---|---|---|---|
| 5,184,800 | A * | 2/1993 | Tabler | 256/12.5 |
| 5,254,040 | A * | 10/1993 | Eller et al. | 472/94 |
| 5,269,623 | A * | 12/1993 | Hanson | 404/6 |
| 5,709,053 | A * | 1/1998 | Kuroda | 52/145 |
| 5,779,227 | A * | 7/1998 | Elkins et al. | 256/31 |
| 5,791,094 | A * | 8/1998 | Thomson | 52/64 |
| 6,010,116 | A * | 1/2000 | Knott, Sr. | 256/47 |
| 6,668,504 | B2 * | 12/2003 | Hughart | 52/481.1 |
| 7,036,798 | B1 * | 5/2006 | Olson | 256/12.5 |
| 7,207,551 | B2 * | 4/2007 | Fielden et al. | 256/24 |
| 7,249,767 | B1 * | 7/2007 | Gorton | 273/396 |
| 2009/0139157 | A1 * | 6/2009 | Jones | 52/145 |

FOREIGN PATENT DOCUMENTS

| | | | |
|---|---|---|---|
| EP | 596825 | A1 * | 5/1994 |
| ES | 2 211 240 | A1 | 7/2004 |
| FR | 2775494 | A | 9/1999 |

* cited by examiner

PRACTICE FENCE FOR TENNIS AND SIMILAR GAMES

BACKGROUND

This invention relates to a fence providing an upright surface for practising tennis and similar games.

In the absence of a playing partner, it is an essential and common part of a tennis player's development to practise by hitting a ball against an upright rigid structure from which the ball will rebound to be hit again.

U.S. Pat. No. 4,373,720 discloses a tennis practice backboard having a curved surface designed to allow a ball hit against the backboard to return to approximately the same spot at about the same height every time. The system is constructed from a plurality of panels. Such a structure is however inevitably quite expensive.

The most common forms of upright tennis practice structure are constructed from either rendered brickwork or rendered or unrendered concrete block work. These however are time consuming and disruptive to construct and create a solid non see-through upright structure which can be out of character in many surroundings and which provide a place to hide behind in public parks and open spaces. Other forms of upright tennis practice structure are made from wooden boards which are prone to rotting, generate excessive noise when struck by a tennis ball and also form a solid non see-through structure.

Conventional fencing systems, such as those with which tennis courts are commonly surrounded, are unsuitable for tennis practice because of their semi-rigid nature, mesh size, mesh joining methods and protrusions and fixings on the rebound surface which cause irregular and unpredictable ball rebound behaviour.

FR-A-2775494 discloses a crowd barrier fence wherein upright posts are connected by horizontal bars which support wire mesh panels, with a smaller mesh at the bottom than at the top. Since the posts are exposed between the mesh panels, the fence has overall a relatively uneven surface.

SUMMARY

The present invention provides a fence for tennis practice comprising a plurality of flat rigid mesh panels secured together side by side to form a substantially flat continuous surface, each adjacent pair of panels being connected to and supported by an upright rigid post having a flat front surface abutting a rear surface of one of said pair of panels, an edge of said abutting panels being bent around said post to abut a side surface of the post and the other panel of the pair having an edge bent back to abut the bent-back edge of the other panel, the said bent-back edges being secured together and to a side surface of the post.

Rigid horizontal cross members may be provided along the top and/or bottom of the structure to increase its rigidity. A transverse member may extend across the structure, behind the flat surface, to simulate the top of a tennis net. A further transverse member may be provided at a higher level to represent a line below which a well struck ball should hit the surface.

The flat continuous surface, supported at intervals by upright posts, can provide a rebound surface for tennis balls and the like free of protrusions which might cause unpredictable rebound. The rigidity of the mesh panels, and the concealment of the support posts behind them, help to provide even rebound characteristic across the whole surface. To make the rebound characteristics still more even, as well as deadening the noise of ball impact, a strip of polymeric material or the like may be provided between the front support surface of each post and the back of the mesh panel. This strip may for example be of hard rubber or other resilient polymeric material.

The fence provides a see-through structure for increased security, and has the added advantage that the player can be observed through the fence by a coach or other spectator, who is not in danger of being hit by a ball.

The practice fence of the invention may suitably be incorporated as part of a surround fence for a tennis court. The upright posts can be permanently secured in the ground, for example by concreting, or may be bolted to the floor, socketed into the floor or set in weighted blocks on the floor.

The fence preferably comprises at least four rigid panels and at least five upright posts. While the number of posts may vary, it is preferable to have a central post dividing the fence into two equal halves, thus representing the centre line of a tennis court. For this reason an odd number of posts is preferred.

The support posts are preferably of square or rectangular box-section, but could alternatively be formed from right-angle sections. The flat front surface and the side surface to which the edges of the mesh panels are secured should preferably be at right-angles to one another, the bent-back side edges of adjacent mesh panels also being bent at right-angles to the rebound surface so as to be joined to the same side surface of each upright post to form a close-fitting butt joint on the rebound surface.

The rigid mesh preferably comprises two arrays of parallel coplanar wires, the two arrays being secured together with their respective wires extending in transverse directions in adjacent planes. Preferably the wires of one array are vertical and those of the other array are horizontal. In some embodiments the wires of one array are more closely spaced than those of the other and from the rebound surface.

Preferred embodiments of the invention will now be described by way of example, with reference to the accompanying drawings in which:

DETAILED DESCRIPTION

Figure 1:
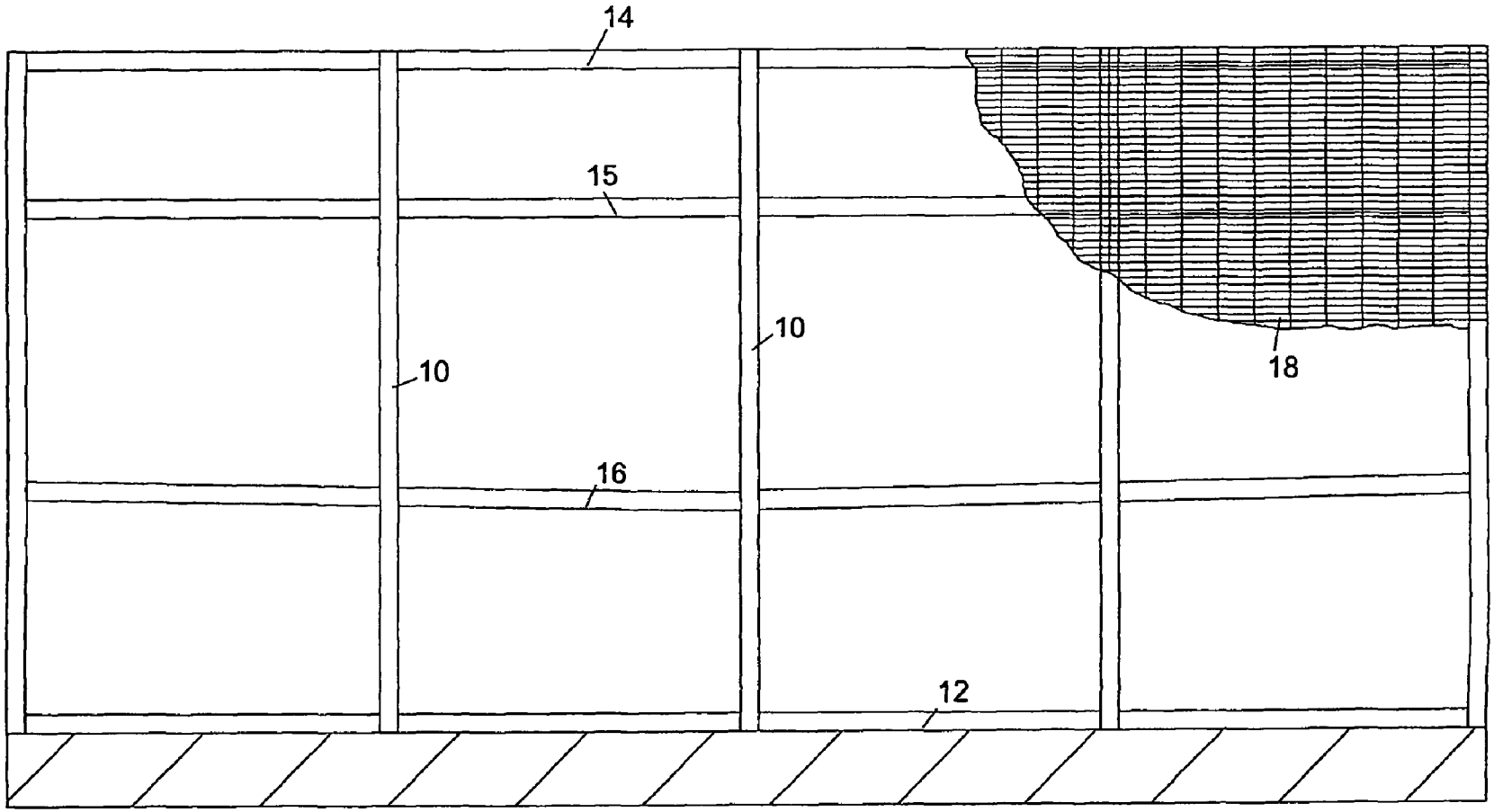
FIG. 1 is a front view of a tennis practice fence in accordance with the present invention, showing cut away sections of two rigid mesh panels.

Referring first to FIG. 1, a tennis practice screen comprises a row of spaced apart vertical posts (10), rigidly secured in position and connected together by horizontal ground members (12) and horizontal top members (14) to form a rigid rectangular frame. The frame may suitably be slightly wider than a tennis court (about 11 m), and may suitably be three to five meters in height. Since the fence can be conveniently supplied in 2 meter widths, two such sections would be suitable for most purposes.

The posts (10) are preferably spaced apart by equal distances, and are also connected together by transverse members (15 and 16). As well as enhancing the rigidity of the structure, these two transverse members are designed to be seen by a player and to define upper and lower limits of a target area of the fence.

The transverse member (15) is horizontal and positioned approximately 1.95 m above the ground, and may have a red, white or other coloured surface facing a player to indicate a line below which shots should be aimed. The exact height above the ground could be varied as required, but would usually be in a range of 1.9-2.0 m.

The lower transverse member (16) is intended to represent the top of a tennis net, and thus is not precisely horizontal but comprises two halves, each sloping slightly downwardly from an outermost vertical post to a central vertical post. It may be coloured and dimensioned to represent the tape of a tennis net.

Secured to the posts (10) are a set of rigid mesh panels (18), each of which is of substantially the same height as the posts and has a width equal to the spacing between the posts. Each of the mesh panels is secured to two of the posts as will be described in more detail below, so that they form a substantially continuous flat mesh surface.

Figure 2:
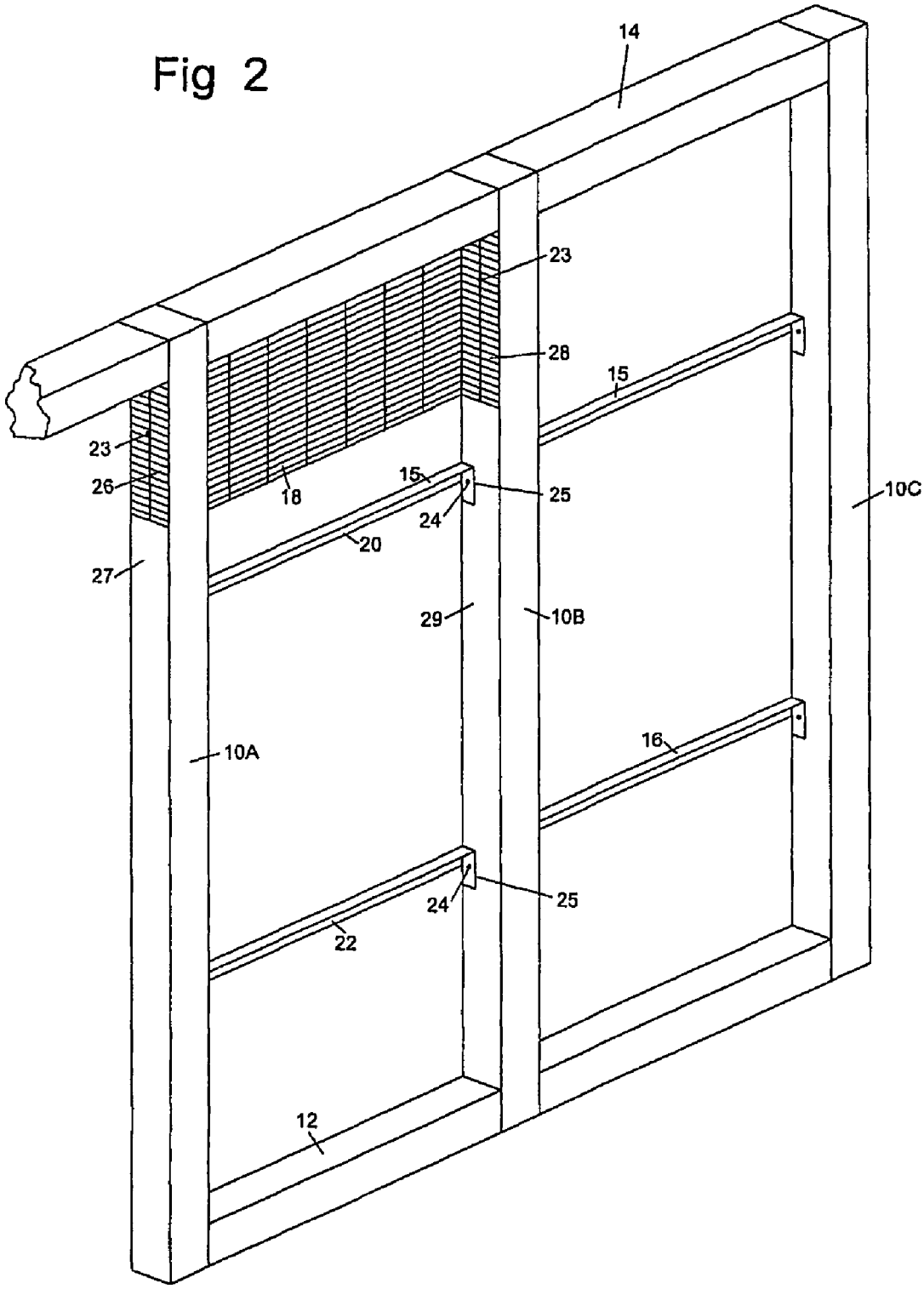
FIG. 2 is a rear view of a central section of the fence of FIG. 1, again showing a cut away section of a rigid mesh panel.

FIG. 2 is a rear view of a central section of the frame of FIG. 1, showing how the upper and lower transverse members (15 and 16) comprise individual sections secured between the upright posts by a bolt (24) secured through downwardly turned flanges (25) or other suitable fixing means.

A mesh panel (18), only the uppermost section of which is shown, extends between adjacent upright posts (10A and 10B), and has its vertical edges (26, 28) bent backwards and secured to side surfaces of respective posts. The side edge (26) is secured to a side surface (27) of post (10A) which faces away from post (10B), while edge (28) is secured to a surface (29) of post (10B) which faces towards post (10A). The panel shown thus extends across the front surface of post (10A). A similar panel (18) (not shown) extends between posts (10B and 10C), extending across the front surface of post (10B), with its vertical side edge turned backwards between surface (29) of post (10B) and the bent-back edge (28) of the adjacent panel. The abutting edges of pairs of adjacent panels are then secured to the respective vertical posts by suitable fastening means (23), for example screws or bolts.

Figure 3:
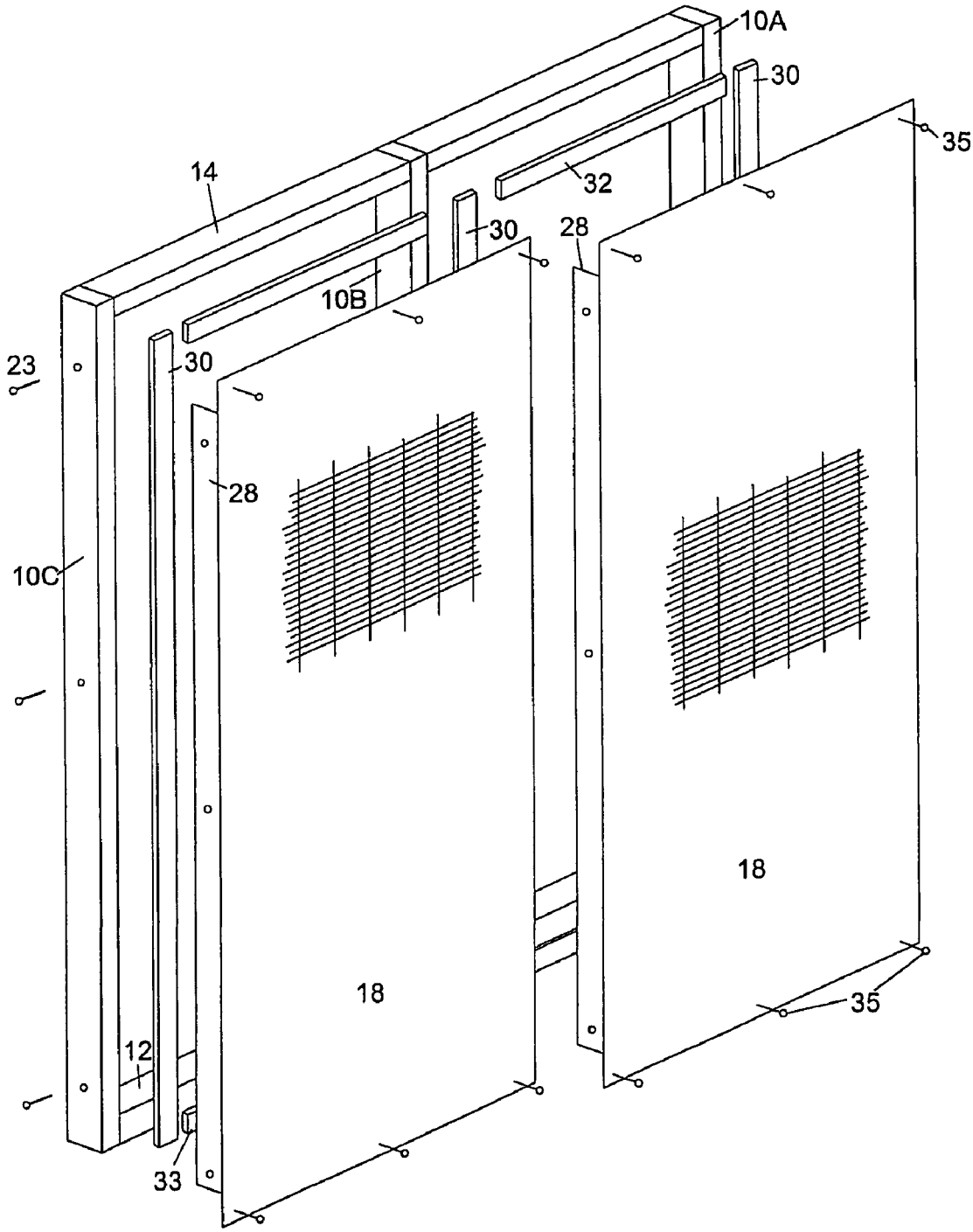
FIG. 3 is an exploded view showing how two sections of the fence of FIG. 1 are assembled.

FIG. 3 is an exploded view showing two mesh screens (18) and the fittings to secure them to the frame of the fence. Upright posts (10A, 10B and 10C) are shown, with two panels (18) the mesh of which is shown only in part.

When the fence is assembled, the turned back vertical edge (28) of the right hand panel as seen in the Figure is butted against the adjacent turned back edge (26) of the left hand panel and the two are butted against the side surface of post (10B) facing post (10A). Similarly, the left hand edge (28) of the left hand panel is secured to the surface of post (10C) which faces post (10B), with a corresponding bent-back edge of an adjacent panel (not shown) interposed between them. The panels are then secured in position by bolts (23), as simply described in more detail below. Additional bolts (35) secure the panels to the top and bottom members (12, 14) of the frame. The heads of these fasteners should as far as possible not protrude in front of the mesh surface of the panels, but since they are at the top and bottom margins of the screen, which a player will want to avoid hitting anyway, this is not crucial.

Noise reduction strips (30, 32, 33) are interposed between the front surfaces of the frame members and the rear surfaces of the panels secured to them. Horizontal strips (32) are secured to the front surfaces of top members (14), strips (33) to the front surfaces of bottom members (12) and vertical strips (30) to the front surfaces of the posts (10). The noise reduction strips may suitably be made from a hard rubber or plastics material, for example an ethylene-propylene diene monomer (EPDM). As well as reducing impact noise, the strips soften the impact of a ball when it strikes a panel directly in front of a frame member, since otherwise there would be a harder impact here than at a central part of the panel.

Figure 4:
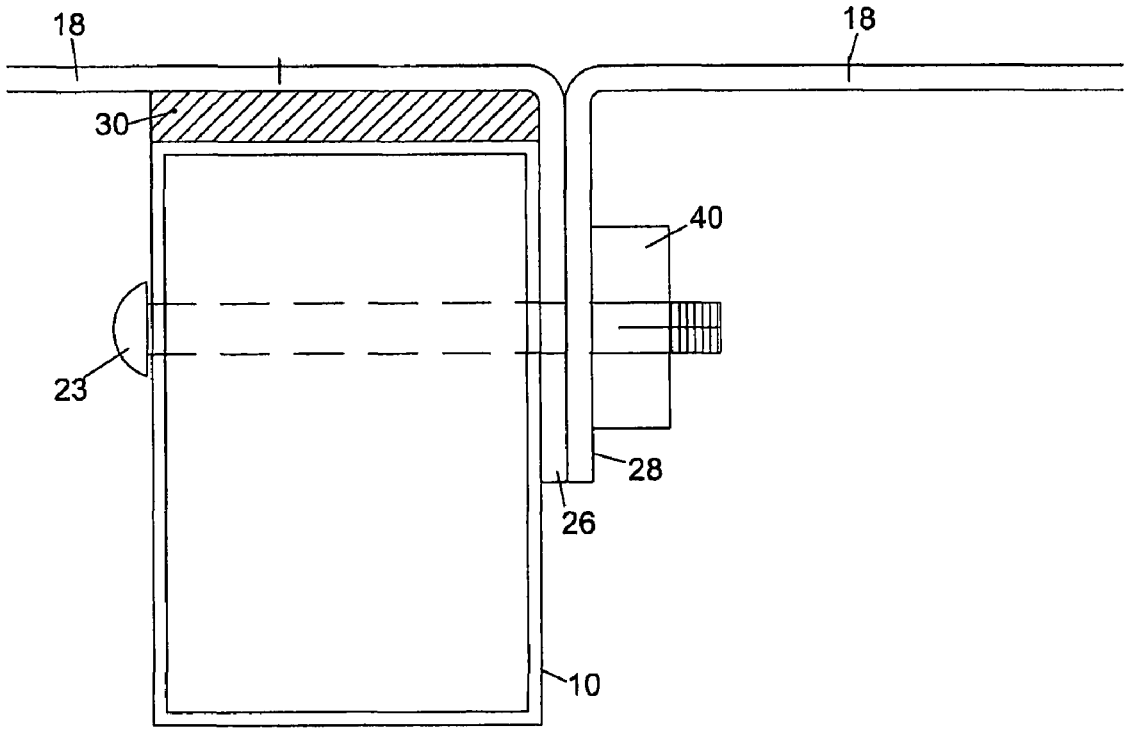
FIG. 4 is a horizontal cross-section through one of the vertical posts of the fence of FIG. 1, showing how two adjacent mesh panels are secured to one another and to the post.

FIG. 4 shows two adjacent mesh panels (18) with their respective bent-back edges (26, 28) butted together and secured to a side surface of a vertical post (10), with a noise reduction strip (30) interposed between the front surface of the post and the rear surface of a panel. The two bent-back edges are secured to the post by means of a bolt (23) passing through the post and secured by a nut (40).

Figure 5:
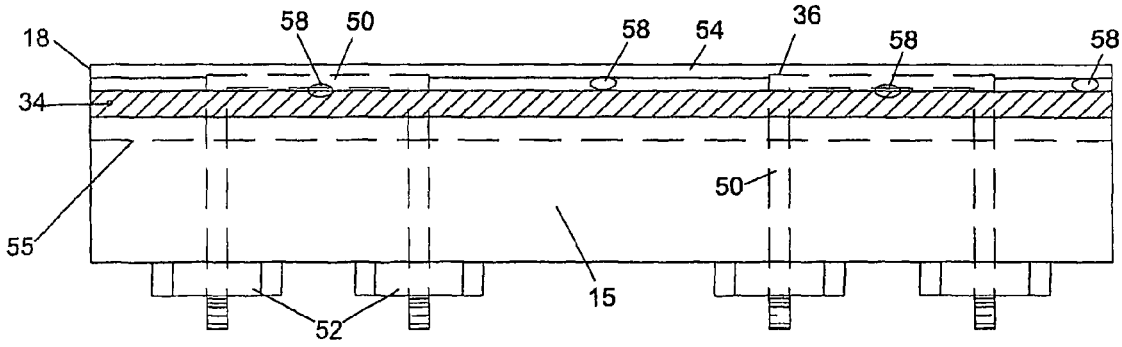
FIG. 5 shows how the mesh panels of the fence of FIG. 1 can be secured to horizontal members of the frame.

For additional rigidity, the panels can be secured at spaced-apart points to the transverse members (15, 16) as shown in FIG. 5. In this Figure, the transverse member (15) is shown as a box-section member, and the panel (18) is secured to it with a noise reduction strip (34) interposed between them. This noise reduction strip can be white or have some other bright colour selected to show clearly through the mesh of the panel.

As can be seen in FIG. 5, the panel (18) comprises horizontal wires (36) with relatively close spacing, for example (2 to 3 cm) and vertical wires (58) with rather larger spacing, for example 5 to 15 cm, typically about 10 cm. The horizontal wires are positioned in front of the vertical ones to constitute the rebound surface of the panel. Any suitable mesh pattern can however be used provided the mesh is small enough to provide a clean rebound for a tennis ball rather than deflecting or trapping it. The spacing between wires should preferably be 4 cm or less in at least one direction.

The staples (50) are fitted around respective vertical wires (58) and are tightly secured to the transverse member (15) by nuts (52). Similar staples can secure the mesh to the lower transverse member (16).

Instead of a box-section, the transverse member (15) can be a right angle members as shown in FIG. 2, in which case the nuts (52) will abut a rear surface of a vertical section of the member, shown in dotted lines as (55).

The rigid mesh used for the practice fence of the invention may suitably be made of polymer-coated steel wire and the posts of box-section steel. The transverse members (15, 16) may be of metal or plastics material, in the form of box-sections or angle members. Instead of the transverse members (15, 16) forming part of the frame, lines could be formed by coloured strips of plastics material or the like secured to the front of the mesh.

The invention claimed is:

1. A tennis practice fence comprising:

a plurality of upright rigid posts, each post comprising a front face and at least one side face orthogonal to the front face;

a plurality of noise reduction strips, each strip having a front side and an opposing rear side, wherein the rear side of each strip is attached to the front face of a respective one of the plurality of posts;

a plurality of flat rigid mesh panels, each panel having a front surface and an opposing rear surface, and each panel having a first end and an opposing second end;

wherein each panel is connected to and extends between adjacent first and second posts of the plurality of posts, such that:

the rear surface of each panel adjacent the first end thereof abuts the front side of the noise reduction strip of the first post and the first end of each panel further comprises a first bent-back portion, wherein the rear surface of each panel at the first bent-back portion is attached to the side face of the first post; and the second end of each panel comprises a second bent-back portion, wherein the front surface of each panel at the second bent-back portion is attached to the side face of the second post;

such that respective first and second bent-back portions of adjacent panels overlap one another and are fastened to the side face of the same post;

whereby the front surfaces of the plurality of panels extending between the side faces of the posts collectively form a planar continuous surface to provide a rebounding surface for tennis balls.

2. A tennis practice fence according to claim 1 wherein said noise reduction strips are made of a material selected from the group consisting of hard rubber and plastics material.

3. A tennis practice fence according to claim 1 which comprises at least four of said mesh panels supported by at least five of said posts.

4. A tennis practice fence according to claim 1 wherein said posts include a central post dividing the fence into two equal halves.

5. A tennis practice fence according to claim 1 wherein the tops of adjacent posts are connected together by horizontal cross members.

6. A tennis practice fence according to claim 1 further comprising a transverse member extending between said posts, to represent the top of a tennis net.

7. A tennis practice fence according to claim 1 wherein said mesh panels comprise first and second arrays of parallel coplanar wires, said first and second arrays being secured together with their respective wires extending in transverse directions in adjacent first and second planes.

8. A tennis practice fence according to claim 7 wherein said first array has wires that are vertical and said second array has wires that are horizontal.

9. A tennis practice fence according to claim 7 wherein said second array has wires that are more closely spaced than those of a second said first array and extend in a first plane, in front of a second plane containing the wires of said second first array.

10. A tennis practice fence according to claim 8 wherein said horizontal wires of said second array are more closely spaced than said vertical wires of said first array and extend in a plane in front of the plane containing the vertical wires.

11. A tennis practice fence comprising:

a plurality of upright rigid posts, each post comprising a front face and at least one side face orthogonal to the front face;

a plurality of flat rigid mesh panels, each panel having a front surface and an opposing rear surface, and each panel having a first end and an opposing second end;

wherein each panel is connected to and extends between adjacent first and second posts of the plurality of posts, such that:

the rear surface of each panel adjacent the first end thereof abuts the front face of the first post and the first end of each panel further comprises a first bent-back portion, wherein the rear surface of each panel at the first bent-back portion is attached to the side face of the first post; and the second end of each panel comprises a second bent-back portion, wherein the front surface of each panel at the second bent-back portion is attached to the side face of the second post;

such that respective first and second bent-back portions of adjacent panels overlap one another and are fastened to the side face of the same post;

whereby the front surfaces of the plurality of panels extending between the side faces of the posts collectively form a planar continuous surface to provide a rebounding surface for tennis balls.

12. A tennis practice fence according to claim 11 wherein a noise reduction strip selected from the group consisting of hard rubber and plastics material is interleaved between said front faces of said posts and the rear surfaces of said panels abutting said post.

13. A tennis practice fence according to claim 11 wherein the tops of adjacent posts are connected together by horizontal cross members.

14. A tennis practice fence according to claim 11 further comprising a transverse member extending between said posts, to represent the top of a tennis net.

15. A tennis fence according to claim 14 further comprising a plurality of said transverse members.

16. A tennis practice fence according to claim 11 wherein said mesh panels comprise two arrays of parallel coplanar wires, the two arrays being secured together with their wires extending in transverse directions in adjacent planes, with said wires of one of said two arrays being vertical and said wires of the other of said two arrays being horizontal.

17. A tennis practice fence according to claim 16 wherein said wires of one of said two arrays are more closely spaced than those of the other of said two arrays and extend in a plane in front of the plane containing the said other array.

* * * * *